US010655582B2

(12) United States Patent
Ohrt et al.

(10) Patent No.: US 10,655,582 B2
(45) Date of Patent: May 19, 2020

(54) LOW-PRESSURE FUEL SUPPLY SYSTEM

(71) Applicant: Caterpillar Motoren GmbH & Co. KG, Kiel (DE)

(72) Inventors: Ole Ohrt, Beringstedt (DE); Stefan Haas, Quarnbek/OT Flemhude (DE); Thorsten Tuexen, Gettorf (DE); Sven Ernst, Kiel (DE)

(73) Assignee: Caterpillar Motoren GmbH & Co. KG, Kiel (DE)

( * ) Notice: Subject to any disclaimer, the term of this patent is extended or adjusted under 35 U.S.C. 154(b) by 548 days.

(21) Appl. No.: 15/147,949

(22) Filed: May 6, 2016

(65) Prior Publication Data

US 2016/0333834 A1 Nov. 17, 2016

(30) Foreign Application Priority Data

May 13, 2015 (EP) ..... 15167661

(51) Int. Cl.
*F02M 37/18* (2006.01)
*F02M 37/00* (2006.01)
(Continued)

(52) U.S. Cl.
CPC ..... *F02M 37/18* (2013.01); *F02D 17/04* (2013.01); *F02D 33/006* (2013.01); *F02D 41/042* (2013.01); *F02M 37/0052* (2013.01); *F02M 63/0054* (2013.01); *F02D 41/22* (2013.01); *F02D 41/38* (2013.01);
(Continued)

(58) Field of Classification Search
CPC combination set(s) only.
See application file for complete search history.

(56) References Cited

U.S. PATENT DOCUMENTS 4,565,170 A 1/1986 Grieshaber et al.
7,240,667 B2 7/2007 Dölker
(Continued)

FOREIGN PATENT DOCUMENTS

CN 102155312 4/2014
EP 2497924 9/2012
(Continued)

OTHER PUBLICATIONS

European Search Report dated Nov. 25, 2015.

*Primary Examiner* — Stephen K Cronin
*Assistant Examiner* — Ruben Picon-Feliciano

(57) ABSTRACT

A fuel supply system for an internal combustion engine may include a plurality of fuel injection pumps, each fuel injection pump being configured to pressurize fuel and provide the pressurized fuel to an associated fuel injector. The fuel supply system may further include a low-pressure fuel supply line fluidly connected to the plurality of fuel injection pumps and configured to provide fuel from a fuel supply tank to the plurality of fuel injection pumps. The fuel supply system may still further include a low-pressure fuel return line fluidly connected to the plurality of fuel injection pumps and configured to return remaining fuel from the plurality of fuel injection pumps to the fuel supply tank. The fuel supply system may include a first fuel cut-off valve disposed in the low-pressure fuel supply line and configured to stop a flow of fuel from the fuel supply tank to the plurality of fuel injection pumps.

18 Claims, 4 Drawing Sheets

(51) Int. Cl.

| | |
|---|---|
| ***F02D 33/00*** | (2006.01) |
| ***F02D 17/04*** | (2006.01) |
| ***F02D 41/04*** | (2006.01) |
| ***F02M 63/00*** | (2006.01) |
| ***F02D 41/22*** | (2006.01) |
| ***F02D 41/38*** | (2006.01) |
| ***F02M 55/02*** | (2006.01) |
| ***F02M 63/02*** | (2006.01) |

(52) U.S. Cl.
CPC ..... *F02M 37/0023* (2013.01); *F02M 55/02* (2013.01); *F02M 63/0045* (2013.01); *F02M 63/0215* (2013.01)

(56) References Cited

U.S. PATENT DOCUMENTS

| | | | | |
|---|---|---|---|---|
| 7,353,800 | B2 | 4/2008 | Gibson | |
| 2011/0011369 | A1* | 1/2011 | Jaasma | F02D 19/0647 123/304 |
| 2011/0023830 | A1* | 2/2011 | Haas | F02D 33/006 123/446 |
| 2011/0209689 | A1* | 9/2011 | Kuhn | B60K 15/01 123/495 |
| 2011/0232270 | A1 | 9/2011 | Burkitt | |
| 2014/0283795 | A1* | 9/2014 | Kimura | F02M 25/0809 123/520 |
| 2016/0230733 | A1* | 8/2016 | Grange | F02M 63/029 |
| 2016/0245217 | A1* | 8/2016 | Takeuchi | F02M 21/0221 |

FOREIGN PATENT DOCUMENTS

| | | |
|---|---|---|
| GB | 791062 | 2/1958 |
| GB | 2294130 | 4/1996 |
| JP | 57-93649 | 6/1982 |
| JP | 2001-349256 | 12/2001 |
| JP | 2005-155630 | 6/2005 |
| JP | 2006-257934 | 9/2006 |

* cited by examiner

LOW-PRESSURE FUEL SUPPLY SYSTEM

CLAIM FOR PRIORITY

This application claims the benefit of priority under 35 U.S.C. § 119(a) of European Patent Application No. 15167661.6, filed May 13, 2015, which is incorporated herein in its entirety by reference.

TECHNICAL FIELD

The present disclosure generally relates to a fuel supply system for an internal combustion engine and in particular to a low-pressure fuel supply system.

BACKGROUND

In internal combustion engines with pump-line-nozzle configurations, each engine cylinder is typically associated with a separate fuel injection pump disposed in close proximity to the cylinder. Each fuel injection pump is configured to pressurize fuel provided by a low-pressure fuel supply line and to transfer the pressurized fuel to an associated fuel injector. The fuel injector then injects the pressurized fuel into the cylinder where a mixture of fuel and air is combusted to provide power.

In some cases, for example in case of an emergency, the internal combustion engine has to stop its operation. Thus, provisions have to be made for reliably and quickly stopping the operation of the internal combustion engine. A fuel supply device configured to stop the operation of a Diesel engine is disclosed in JPS5793649 (A). The fuel supply device includes a fuel supply stop valve installed between an injection pump and an auxiliary filter. By this arrangement an interval between the fuel stop valve and the injection pump is reduced, a fuel pipe is shortened and hence engine stoppage may be hastened.

The present disclosure is directed, at least in part, to improving or overcoming one or more aspects of prior systems.

SUMMARY OF THE DISCLOSURE

According to one aspect of the present disclosure, a fuel supply system for an internal combustion engine is disclosed. The fuel supply system comprises a plurality of fuel injection pumps, each fuel injection pump being configured to pressurize fuel and provide the pressurized fuel to an associated fuel injector. The fuel supply system further comprises a low-pressure fuel supply line fluidly connected to the plurality of fuel injection pumps and configured to provide fuel from a fuel supply tank to the plurality of fuel injection pumps. The fuel supply system further comprises a low-pressure fuel return line fluidly connected to the plurality of fuel injection pumps and configured to return remaining fuel from the plurality of fuel injection pumps to the fuel supply tank. The fuel supply system further comprises a first fuel cut-off valve disposed in the low-pressure fuel supply line and configured to stop a flow of fuel from the fuel supply tank to the plurality of fuel injection pumps.

According to another aspect of the present disclosure, a method of operating a fuel supply system for an internal combustion engine is disclosed. The fuel supply system comprises a plurality of fuel injection pumps, a low-pressure fuel supply line connected to the plurality of fuel injection pumps and configured to provide fuel from a fuel supply tank to the plurality of fuel injection pumps, a low-pressure fuel return line fluidly connected to the plurality of fuel injection pumps and configured to return remaining fuel from the plurality of fuel injection pumps to the fuel supply tank, and a first fuel cut-off valve disposed in the low-pressure fuel supply line. The method comprises the steps of receiving an emergency stop input indicative of an emergency of the internal combustion engine; and closing the first fuel cut-off valve to stop a flow of fuel from the low-pressure fuel supply line to the plurality of fuel injection pumps.

According to yet another aspect of the present disclosure, an internal combustion engine is disclosed. The internal combustion engine may include an engine block, the engine block including a plurality of cylinders, at least one fuel injector associated with each of the plurality of cylinders and configured to inject fuel into each of the plurality of cylinders, and a fuel supply system for supplying fuel to each of the at least one fuel injector. The fuel supply system may include a plurality of fuel injection pumps, wherein each fuel injection pump may be configured to pressurize fuel and provide the pressurized fuel to an associated one of the at least one fuel injector. The fuel supply system may also include a low-pressure fuel supply line fluidly connected to the plurality of fuel injection pumps and configured to provide fuel from a fuel supply tank to the plurality of fuel injection pumps, a low-pressure fuel return line fluidly connected to the plurality of fuel injection pumps and configured to return remaining fuel from the plurality of fuel injection pumps to the fuel supply tank, and a first fuel cut-off valve disposed in the low-pressure fuel supply line and configured to stop a flow of fuel from the fuel supply tank to the plurality of fuel injection pumps Other features and aspects of this disclosure will be apparent from the following description and the accompanying drawings.

BRIEF DESCRIPTION OF THE DRAWINGS

The accompanying drawings, which are incorporated herein and constitute a part of the specification, illustrate exemplary embodiments of the disclosure and, together with the description, serve to explain the principles of the disclosure. In the drawings.

DETAILED DESCRIPTION

Figure 1:
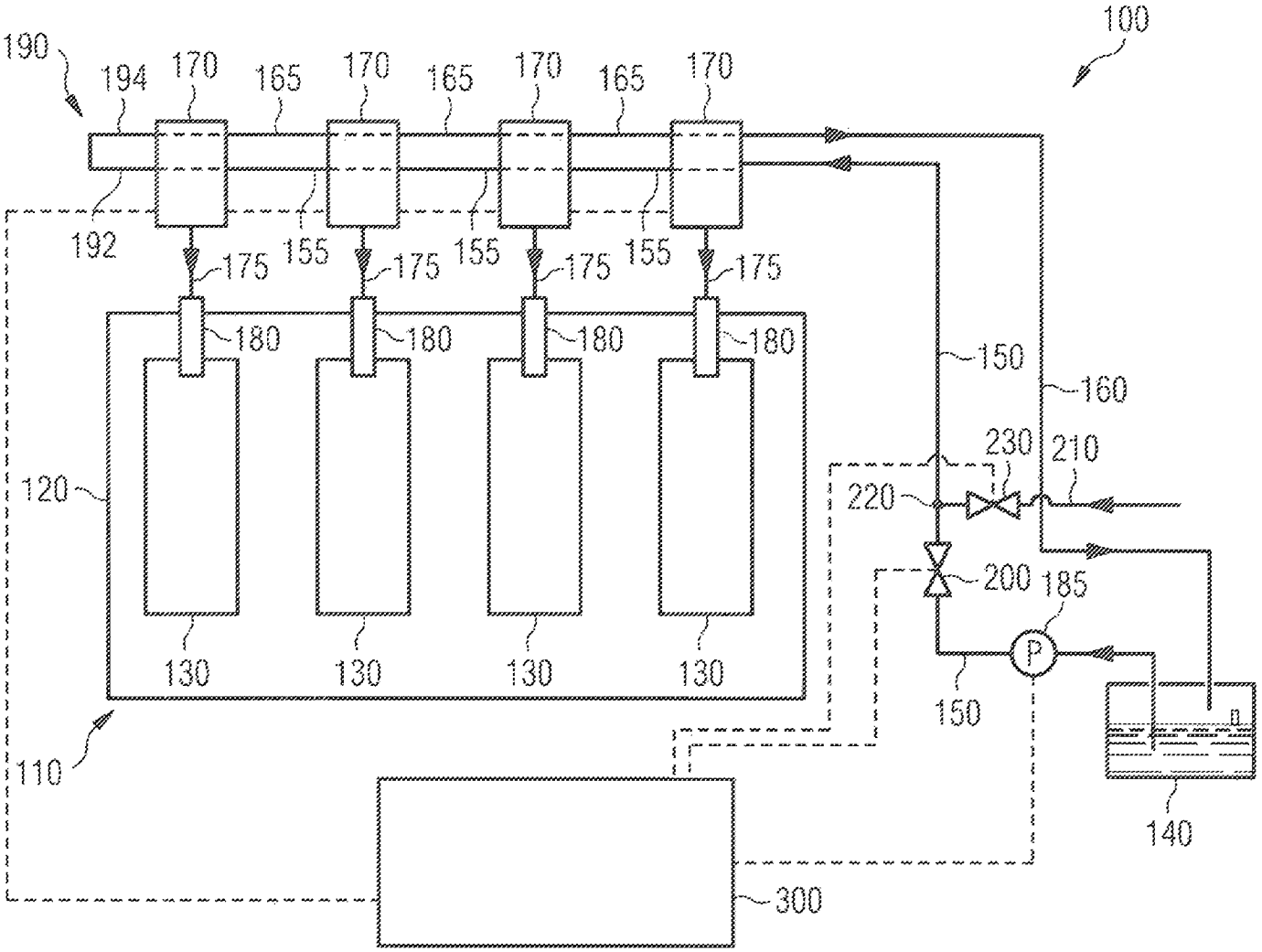
FIG. 1 shows a schematic drawing of an exemplary fuel supply system with a first fuel cut-off valve and a purge gas supply line.

The following is a detailed description of exemplary embodiments of the present disclosure. The exemplary embodiments described therein and illustrated in the drawings are intended to teach the principles of the present disclosure, enabling those of ordinary skill in the art to implement and use the present disclosure in many different environments and for many different applications. Therefore, the exemplary embodiments are not intended to be, and should not be considered as, a limiting description of the scope of patent protection. Rather, the scope of patent protection shall be defined by the appended claims.

The present disclosure is based in part on the realization that another possibility of stopping the operation of the internal combustion engine, for example in case of an emergency, is by preventing the fuel injection pumps from pressurizing fuel. Pressurizing fuel may be prevented by connecting the fuel injection pumps to an emergency stop air line. During normal operation of the internal combustion engine, the emergency stop air line is depressurized ensuring normal operation of the fuel injection pumps. In case the internal combustion engines exhibits an emergency, the emergency stop air line is pressurized to prevent the fuel injection pumps from pressurizing the fuel. As a result, no more fuel is injected into the combustion chamber and the internal combustion engine stops its operation.

The present disclosure is further based in part on the realization that it is not known prior to pressurizing the emergency stop air line whether the emergency stop air line is functional or not. For example, the emergency stop air line may not be air tight. In those cases, pressurization of the emergency stop air line may not cause the fuel injection pump to stop pressurizing fuel. As the fuel injection pumps continue to pressurize fuel, the internal combustion engine may still operate despite the provision of the emergency stop air line.

The present disclosure is thus based in part on the realization that in addition or alternatively to the emergency stop air line, the fuel supply system includes a first fuel cut-off valve. The first fuel cut-off valve is disposed in a low-pressure fuel supply line fluidly connected to a fuel supply tank and the fuel injection pumps. The first fuel cut-off valve is configured to stop a flow of fuel from the fuel supply tank to the fuel injection pumps. As a result, the internal combustion engine can only consume remaining fuel contained in the low-pressure fuel supply line downstream of the first fuel cut-off valve. Once the remaining fuel is consumed by the internal combustion engine, the internal combustion engine stops its operation.

The present disclosure is further based in part on the realization that a second fuel cut-off valve is disposed in a low-pressure fuel return line. The low-pressure fuel return line is fluidly connected to the fuel injection pumps and the fuel supply tank and returns excess fuel not used by the fuel injection pumps to the fuel supply tank. The second fuel cut-off valve is configured to stop a flow of fuel in the low-pressure fuel return line from the fuel supply tank back to the fuel injection pumps. The second fuel cut-off valve prevents that remaining fuel in the low-pressure fuel return line is sucked back into the fuel injection pumps. By using a second fuel cut-off valve, a time until internal combustion engine stops its operation is reduced.

The present disclosure is further based in part on the realization that a purge gas supply line is fluidly connected to the low-pressure fuel supply line and/or the low-pressure fuel return line. The purge gas supply line provides a flow of purge gas and is configured to purge the low-pressure fuel supply line and the low-pressure fuel return line. By enabling a flow of purge gas, remaining fuel in the low-pressure fuel supply line and the low-pressure fuel return line is forced out of the low-pressure fuel supply line and the low-pressure fuel return line. In other words, the remaining fuel is discharged from the low-pressure fuel supply line and the low-pressure fuel return line. The remaining fuel together with the flow of purge gas may then be returned into the fuel supply tank or may be directed into a fuel waste tank. As a result of the purging, the time until the internal combustion engine stops its operation is reduced and less fuel is consumed by the internal combustion engine.

Referring now to the drawings, FIG. 1 shows a schematic diagram of an exemplary fuel supply system 100 for an internal combustion engine 110.

Internal combustion engine 110 may be any internal combustion engine known to the skilled person. For example, internal combustion engine 110 may be a Diesel internal combustion engine or a dual-fuel internal combustion engine. Moreover, internal combustion engine 110 may be a spark ignited or a self-ignited internal combustion engine.

Internal combustion engine 110 includes an engine block 120. Engine block 120 includes a plurality of cylinders 130. Exemplarily, four cylinders 130 are shown in FIG. 1. The skilled person will however appreciate that engine block 120 may comprise any numbers of cylinders 130, for example, 6, 7, 8, 9, 10, 12, 16, 20 or more. Engine block 120 may also comprise less than 6 cylinders 130. Cylinders 130 are disposed in engine block 120 in any configuration, for example, in a "V", in-line or radial configuration.

Fuel supply system 100 includes a fuel supply tank 140, a low-pressure fuel supply line 150, a low-pressure fuel return line 160, and a plurality of fuel injection pumps 170 fluidly connected to a plurality of fuel injectors 180.

Fuel supply tank 140 is configured to provide fuel to cylinders 130. Fuel supply tank 140 may contain any type of fuel required to power cylinder 130. For example, fuel supply tank 140 may contain a liquid fuel such as Diesel. In some embodiments, fuel supply tank 140 may include an auxiliary fuel supply tank (not shown) to supply auxiliary fuel to cylinders 130 such as, for example, heavy fuel oil (HFO).

Low-pressure fuel supply line 150 is configured to provide fuel from fuel supply tank 140 to a plurality of fuel injection pumps 170. For this, low-pressure fuel supply line 150 is fluidly connected to fuel supply tank 140 and fluidly connected to the plurality of fuel injection pumps 170. For example, low-pressure fuel supply line 150 may be fluidly connected to the plurality of fuel injection pumps 170 via low-pressure fuel supply line portions 155.

Fuel injection pumps 170 are arranged in close proximity to cylinders 130. For example, fuel injection pumps 170 are disposed next to a cylinder head (not shown) of internal combustion engine 110. Thus, each fuel injection pump 170 is associated with a corresponding cylinder 130. Or in other words, each cylinder 130 is served by a separate fuel injection pump 170. Each fuel injection pump 170 is configured to pressurize fuel supplied by low-pressure fuel supply line 150. Each fuel injection pump 170 is configured to provide the pressurized fuel to a corresponding fuel injector 180. For this, each fuel injection pump 170 is fluidly connected to the corresponding fuel injector 180 via a high-pressure fuel supply line 175. High-pressure fuel supply line 175 is configured to permit a flow of pressurized fuel only in the direction from fuel injection pump 170 to fuel injector 180 and not vice versa, as indicated by the arrow. In some embodiments, fuel injection pump 170, high-pressure fuel supply line 175 and fuel injector 180 may be formed as a unit.

Fuel injection pump 170 is in control communication with a control unit 300 as indicated by the dashed line and is either hydraulically or mechanically controlled by control unit 300. In case fuel injection pump 170 is hydraulically controlled, each fuel injection pump 170 is fluidly connected to a high-pressure oil pump (not shown) for supplying oil to control fuel injection pumps 170. In case fuel injection pump 170 is mechanically controlled, each fuel injection pump 170 is fluidly connected to a camshaft (not shown) of internal combustion engine 110 for mechanically controlling fuel injection pumps 170.

Each fuel injector 180 at least partly protrudes into a corresponding cylinder 130 of engine block 120. Each fuel injector 180 is configured to inject a certain amount of fuel into cylinder 130 where the fuel is then mixed with air and combusted to provide power. Engine block 120 may thus include further components not shown in FIG. 1 such as air supply lines, inlet and outlet valves, control lines for controlling the inlet and outlet valves, etc. Fuel injectors 180 may be any type of fuel injector 180 known to the skilled person. In some embodiments, fuel injectors 180 may be in control communication with control unit 300. In those embodiments, control unit 300 is further connected to fuel injectors 180 via control lines not shown.

Fuel continuously circulates through fuel injection pumps 170. Fuel not consumed by fuel injection pumps 170, e.g. excess fuel, is returned to fuel supply tank 140 via low-pressure fuel return line 160. For this, low-pressure fuel return line 160 is fluidly connected to the plurality of fuel injection pumps 170 via low-pressure fuel return line portions 165, and fluidly connected to fuel supply tank 140.

In some embodiments, as exemplarily shown in FIG. 1, low-pressure fuel supply line 150 and low-pressure fuel return line 160 are fluidly connected to each other via a low-pressure fuel end connection line 190. Low-pressure fuel end connection line 190 may be U-shaped including a first leg 192 and a second leg 194. First leg 192 connects to low-pressure fuel supply line 150 at an end of the plurality of fuel injection pumps 170 downstream of the plurality of fuel injection pumps 170 when viewed in flow direction of fuel. Second leg 194 connects to low-pressure fuel return line 160 at the same end of the plurality of fuel injection pumps 170. Thus, low-pressure fuel connection end line 190 connects low-pressure fuel supply line 150 and low-pressure fuel return line 160 at an end of the plurality of fuel injection pumps 170. By connecting low-pressure fuel supply line 150 and low-pressure fuel return line 160 via low-pressure fuel end connection line 190, low-pressure fuel supply line 150 is short-circuited with low-pressure fuel return line 160, thereby allowing fresh fuel to continuously cool fuel injection pumps 170.

For circulating fuel through low-pressure fuel supply line 150 and low-pressure fuel return line 160, fuel supply system 100 includes a fuel transfer pump 185. Fuel transfer pump 185 is in control communication with control unit 300 as indicated by the dashed line. Fuel transfer pump 185 may be any type of pump known to the skilled person and suited to the application at hand. For example, fuel transfer pump 185 may be a self-priming pump or a non-self-priming pump.

Fuel supply system 100 may further include a fuel pressure regulation device (not shown) disposed in low-pressure fuel return line 160 and configured to return fuel from the plurality of fuel injection pumps 170 to fuel supply tank 140. Moreover, fuel supply system 100 may further include one or more fuel particulate filters (not shown) disposed in low-pressure fuel supply line 150 and configured to remove contaminants from the fuel.

As can be seen in FIG. 1, fuel supply system 100 further includes a first fuel cut-off valve 200. First fuel cut-off valve 200 is disposed in low-pressure fuel supply line 150 downstream of fuel supply tank 140 and upstream of the plurality of fuel injection pumps 170. First fuel cut-off valve 200 is configured to stop a flow of fuel from fuel supply tank 140 to the plurality of fuel injection pumps 170. First fuel cut-off valve 200 is in control communication with control unit 300 as indicated by the dashed line. Control unit 300 controls a position of first fuel cut-off valve 200. For example, in case of an emergency, control unit 300 sends a task to first fuel cut-off valve 200 to close first fuel cut-off valve 200, thereby stopping a flow of fuel from fuel supply tank 140 to the plurality of fuel injection pumps 170. In other words, a fluid connection between low-pressure fuel supply line 150 and the plurality of fuel injection pumps 170 is disabled.

By stopping a flow of fuel from fuel supply tank 140 to the plurality of fuel injection pumps 170, no more fuel is supplied to fuel injection pumps 170. Thus, fuel injection pumps 170 can only pump and pressurize a remaining amount of fuel contained in low-pressure fuel supply line 150 and low-pressure fuel supply line portions 155 downstream of first fuel cut-off valve 200. As a result, upon closing first fuel cut-off valve 200, internal combustion engine 110 ceases to operate, e.g. stops operating once the remaining fuel is consumed. A typical time between closing first fuel cut-off valve 200 and internal combustion engine 110 stopping its operation is, for example, about 10 minutes. Depending on the size, type and operation parameters of internal combustion engine 110, the time until internal combustion engine 110 stops its operation may be larger or smaller than 10 minutes. First fuel cut-off valve 200 may be any type of valve known to the skilled person and suited to the application at hand. For example, first fuel cut-off valve 200 may be a pneumatic valve or a solenoid valve.

As can be seen in FIG. 1, fuel supply system 100 further includes a purge gas supply line 210. Purge gas supply line 210 is fluidly connected to a purge gas supply tank (not shown). Purge gas supply line 210 is further fluidly connected to low-pressure fuel supply line 150 at a connection point 220. Connection point 220 is disposed downstream of first fuel cut-off valve 200 and upstream of the plurality of fuel injection pumps 170. Purge gas supply line 210 is configured to supply a flow of purge gas such that low-pressure fuel supply line 150 and low-pressure fuel return line 160 are purged with purge gas once first fuel cut-off valve 200 is closed. Purge gas may be nitrogen, air or any other suitable purge gas.

Purge gas supply line 210 further includes a purge gas control valve 230. Purge gas control valve 230 is in control communication with control unit 300 as indicated by the dashed line. Purge gas control valve 230 is configured to control a flow of purge gas through purge gas supply line 210 and subsequently through low-pressure fuel supply line 150 and low-pressure fuel return line 160. Upon enabling a flow of purge gas through purge gas supply line 210, remaining fuel contained in low-pressure fuel supply line 150, low-pressure fuel supply line portion 155, low-pressure fuel return line 160 and low-pressure fuel return line portion 165 is forced out together with the flow of purge gas. The remaining fuel and the flow of purge gas are then returned into fuel supply tank 140.

To bleed purge gas from the fuel, fuel supply tank 140 may include a bleed valve (not shown). Moreover, to bleed purge gas from low-pressure fuel supply line 150 and low-pressure fuel return line 160, fuel transfer pump 185 may be operated prior to the operation of internal combustion engine 110. In embodiments where fuel transfer pump 185 is not a self-priming pump, fuel supply system 100 may further include a fuel priming pump (not shown). The fuel priming pump may be operated before operation of fuel transfer pump 185 to bleed remaining purge gas out of low-pressure fuel supply line 150 and low-pressure fuel return line 160.

In some embodiments, purge gas supply line 210 may be connected to low-pressure supply line 150 via first fuel cut-off valve 200. In those embodiments, first fuel cut-off valve 200 may be a 3/2 valve.

By enabling a flow of purge gas through purge gas supply line 210, remaining fuel contained in low-pressure fuel supply line 150, low-pressure fuel supply line portions 155, low-pressure fuel return line 160 and low-pressure fuel return line portions 165 is discharged faster from low-pressure fuel supply line 150 and low-pressure fuel return line 160. As a result, the time until internal combustion engine 110 stops its operation, once first fuel cut-off valve 200 is closed, is reduced. A typical reduction of time may be, for example, about 90% compared to a time when a flow of purge gas is disabled.

Figure 2:
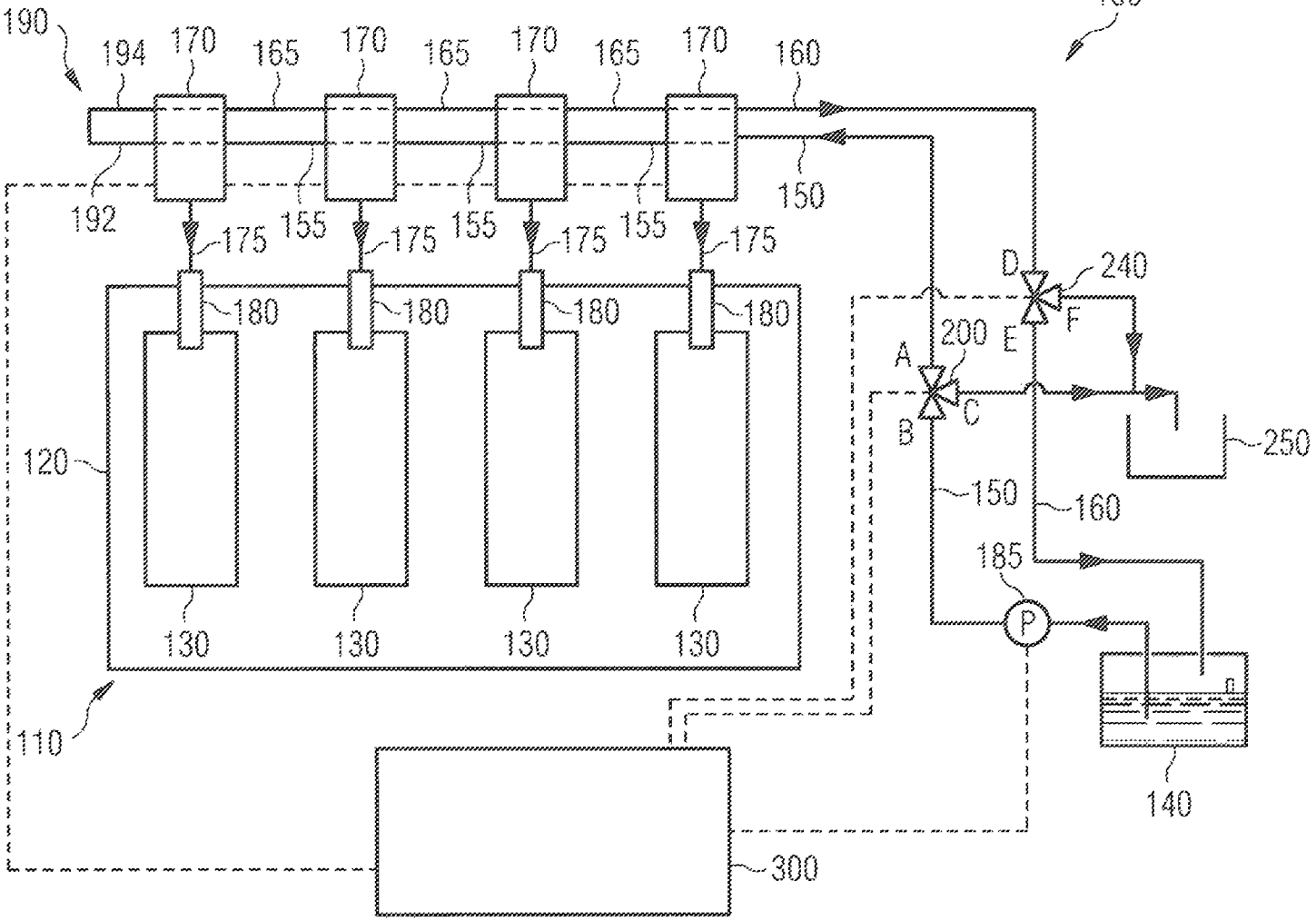
FIG. 2 shows a schematic drawing of another exemplary fuel supply system with a second fuel cut-off valve and a fuel waste tank.

Referring to FIG. 2, another exemplary fuel supply system 100 is schematically shown. Elements already explained in connection with FIG. 1 such as first fuel cut-off valve 200 have the same reference numerals.

As can be seen, fuel supply system 100 includes a second fuel cut-off valve 240. Second fuel cut-off valve 240 is disposed in low-pressure fuel return line 160 downstream of the plurality of fuel injection pumps 170 and upstream of fuel supply tank 140. Second fuel cut-off valve 240 is configured to stop a flow of fuel from fuel supply tank 140 to the plurality of fuel injection pumps 170.

Second fuel cut-off valve 240 is in control communication with control unit 300 as indicated by the dashed line. Control unit 300 controls a position of second fuel cut-off valve 240. For example, in case of an emergency, control unit 300 sends a task to first fuel cut-off valve 200 to close first fuel cut-off valve 200, thereby stopping a flow of fuel in low-pressure fuel supply line 150 from fuel supply tank 140 to the plurality of fuel injection pumps 170. Moreover, control unit 300 sends a task to second fuel cut-off valve 240 to close second fuel cut-off valve 240, thereby stopping a flow of fuel in low-pressure fuel return line 160 from fuel supply tank 140 back to the plurality of fuel injection pumps 170. In other words, once second fuel cut-off valve 240 is closed, a fluid connection between low-pressure fuel return line 160 and the plurality of fuel injection pumps 170 is disabled.

By stopping a flow of fuel in low-pressure fuel return line 160 from fuel supply tank 140 back to the plurality of fuel injection pumps 170, fuel contained in low-pressure fuel return line 160 cannot be sucked back by the plurality of fuel injection pumps 170. Thus, fuel injectors 180 can only consume a remaining amount of fuel contained in low-pressure fuel supply line 150 and low-pressure fuel supply line portions 155 downstream of first fuel cut-off valve 200 and a remaining amount of fuel contained in low-pressure fuel return line 160 and low-pressure fuel return line portions 165 upstream of second fuel cut-off valve 240. As a result, upon closing first fuel cut-off valve 200 and second fuel cut-off valve 240, the time until internal combustion engine 110 stops its operation, after first fuel cut-off valve 200 and second fuel cut-off valve 240 are closed, is reduced. A typical reduction of time may be, for example, about 20% compared to a time when second fuel cut-off valve 240 is not closed or not installed in fuel supply system 100. Second fuel cut-off valve 240 may be any type of valve known to the skilled person and suited to the application at hand. For example, second fuel cut-off valve 240 may be a check valve, a pneumatic valve or a solenoid valve.

As can be further seen in FIG. 2, fuel supply system 100 includes a fuel waste tank 250. Fuel waste tank 250 is fluidly connected to low-pressure fuel supply line 150 via first fuel cut-off valve 200. Fuel waste tank 250 is further fluidly connected to low-pressure fuel return line 160 via second fuel cut-off valve 240. Fuel waste tank 250 is configured to receive discharged fuel from low-pressure fuel supply line 150 and low-pressure fuel return line 160.

For enabling a flow of fuel from low-pressure fuel supply line 150 to fuel waste tank 250, first fuel cut-off valve 200 includes a discharge position where a connection AC between low-pressure fuel supply line 150 and fuel waste tank 250 is enabled and a connection AB between low-pressure fuel supply line 150 and fuel supply tank 140 is disabled. Similarly, for enabling a flow of fuel from low-pressure fuel return line 160 to fuel waste tank 250, second fuel cut-off valve 240 includes a discharge position where a connection DF between low-pressure fuel supply line 150 and fuel waste tank 250 is enabled and a connection DE between low-pressure fuel supply line 150 and fuel supply tank 140 is disabled.

First fuel cut-off valve 200 may be a 3/2 valve with an open position and a discharge position. In the open position of first fuel cut-off valve 200 a connection AB between low-pressure fuel supply line 150 and fuel supply tank 140 is enabled and a connection AC between low-pressure fuel supply line 150 and fuel waste tank 250 is disabled. In the discharge position of first fuel cut-off valve 200 a connection AC between low-pressure fuel supply line 150 and fuel waste tank 250 is enabled and a connection AB between low-pressure fuel supply line 150 and fuel supply tank 140 is disabled.

Likewise, second fuel cut-off valve 240 may be a 3/2 valve with an open position and a discharge position. In the open position of second fuel cut-off valve 240 a connection DE between low-pressure fuel return line 160 and fuel supply tank 140 is enabled and a connection DF between low-pressure fuel return line 160 and fuel waste tank 250 is disabled. In the discharge position of second fuel cut-off valve 240 a connection DF between low-pressure fuel return line 160 and fuel waste tank 250 is enabled and a connection DE between low-pressure fuel return line 160 and fuel supply tank 140 is disabled.

The flow of fuel from low-pressure fuel supply line 150 to fuel waste tank 250 is enabled by switching first fuel cut-off valve 200 from the open position into the discharge position. The flow of fuel from low-pressure return line 160 to fuel waste tank 250 is enabled by switching second fuel cut-off valve 240 from the open position into the discharge position. Control unit 300 may control switching between the two valve positions.

By switching first fuel cut-off valve 200 and second fuel cut-off valve 240 into discharge positions, remaining fuel contained in low-pressure fuel supply line 150 and low-pressure fuel supply line portions 155 downstream of first fuel cut-off valve 200, and remaining fuel contained in low-pressure fuel return line 160 and low-pressure fuel return line portions 165 upstream of second fuel cut-off valve 240 is discharged into fuel waste tank 250. The discharge of fuel into fuel waste tank 250 may be a freely propagating flow, e.g. no fuel transfer pump 185 may be required to discharge fuel into fuel waste tank 250. For this, fuel waste tank 250 may be fluidly connected to the ambience, as indicated in FIG. 2.

By discharging fuel into fuel waste tank 250, a time until internal combustion engine 110 stops its operation is reduced. A typical reduction of time may be, for example, about 50% compared to a time when fuel is not discharged.

In some embodiments, the remaining fuel contained in low-pressure fuel supply line 150 and low-pressure fuel return line 160 may be discharged into fuel supply tank 140. Thus, in those embodiments, no fuel waste tank 150 may be required.

Figure 3:
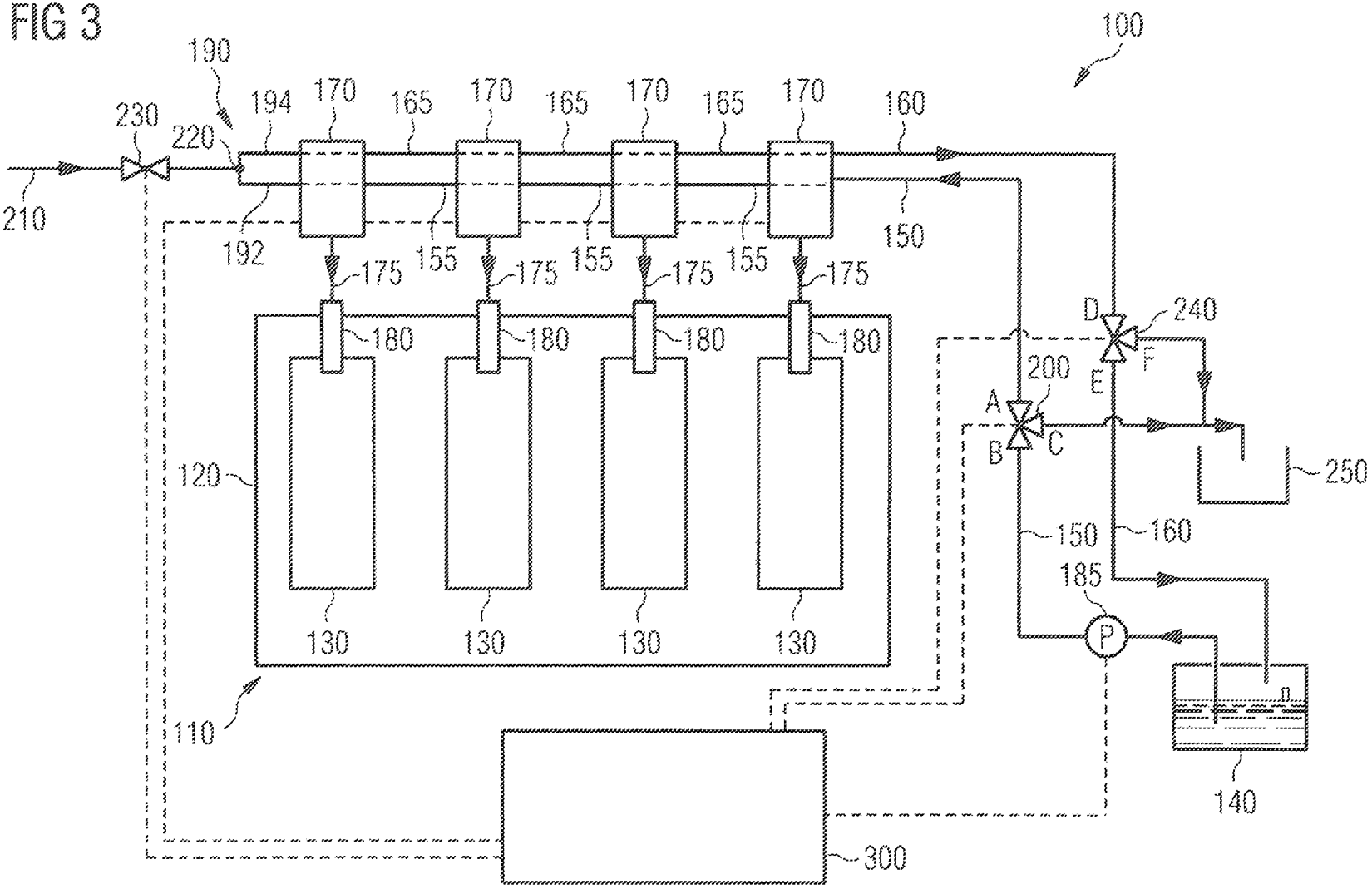
FIG. 3 shows a schematic drawing of another exemplary fuel supply system with a second fuel cut-off valve, a fuel waste tank and a purge gas supply line.

Referring to FIG. 3, another exemplary fuel supply system 100 is schematically shown. Elements already explained in connection with FIGS. 1 and 2 have the same reference numerals.

As can be seen, purge gas supply line 210 is fluidly connected to low-pressure fuel supply line 150 and to low-pressure fuel return line 160 via low-pressure fuel end connection line 190 at connection point 220. Thus, purge gas supply line 210 is connected to low-pressure fuel supply line 150 at an end of the plurality of fuel injection pumps 170, and is connected to low-pressure fuel return line 160 at the same end of the plurality of fuel injection pumps 170.

Purge gas supply line 210 is configured to supply a flow of purge gas such that low-pressure fuel supply line 150 and low-pressure fuel return line 160 are purged with purge gas.

For enabling a flow of purge gas through low-pressure fuel supply line 150, first fuel cut-off valve 200 includes a purge position where a connection AC between low-pressure fuel supply line 150 and fuel waste tank 250 is enabled and where a connection AB between low-pressure fuel supply line 150 and fuel supply tank 140 is disabled. Similarly, for enabling a flow of purge gas through low-pressure fuel return line 160, second fuel cut-off valve 240 includes a purge position where a connection DF between low-pressure fuel supply line 150 and fuel waste tank 250 is enabled and where a connection DE between low-pressure fuel supply line 150 and fuel supply tank 140 is disabled.

First fuel cut-off valve 200 may be a 3/2 valve with an open position and a purge position. In the open position of first fuel cut-off valve 200 a connection AB between low-pressure fuel supply line 150 and fuel supply tank 140 is enabled and a connection AC between low-pressure fuel supply line 150 and fuel waste tank 250 is disabled. In the purge position of first fuel cut-off valve 200 a connection AC between low-pressure fuel supply line 150 and fuel waste tank 250 is enabled and a connection AB between low-pressure fuel supply line 150 and fuel supply tank 140 is disabled.

Likewise, second fuel cut-off valve 240 may be a 3/2 valve with an open position and a purge position. In the open position of second fuel cut-off valve 240 a connection DE between low-pressure fuel return line 160 and fuel supply tank 140 is enabled and a connection DF between low-pressure fuel return line 160 and fuel waste tank 250 is disabled. In the purge position of second fuel cut-off valve 240 a connection DF between low-pressure fuel return line 160 and fuel waste tank 250 is enabled and a connection DE between low-pressure fuel return line 160 and fuel supply tank 140 is disabled.

The flow of purge gas through low-pressure fuel supply line 150 to fuel waste tank 250 is enabled by switching first fuel cut-off valve 200 from the open position into the purge position. The flow of purge gas through low-pressure return line 160 to fuel waste tank 250 is enabled by switching second fuel cut-off valve 240 from the open position into the purge position. Control unit 300 may control switching between the two valve positions.

When first fuel cut-off valve 200 is switched into purge position, remaining fuel contained in low-pressure fuel supply line 150 and low-pressure fuel supply line portions 155 downstream of first fuel cut-off valve 200 is forced into fuel waste tank 250. When second fuel cut-off valve 240 is switched into purge position, remaining fuel contained in low-pressure fuel return line 160 and low-pressure fuel return line portions 165 upstream of second fuel cut-off valve 240 is forced into fuel waste tank 250.

By purging low-pressure fuel supply line 150 and low-pressure fuel return line 160, remaining fuel contained in low-pressure fuel supply line 150, low-pressure fuel supply line portion 155, low-pressure fuel return line 160 and low-pressure fuel return line portions 165 is discharged into fuel waste tank 250 at a shorter time compared to a freely propagating flow when no purge gas is used. As a consequence, a time until internal combustion engine 110 stops its operation is reduced further.

Depending on the flow of purge gas through purge gas supply line 210 a reduction of time may be larger or smaller. Control unit 300 is in control communication with purge gas control valve 230 to control the flow of purge gas through purge gas supply line 210. Purge gas may be nitrogen, air or any other suitable purge gas.

INDUSTRIAL APPLICABILITY

Exemplary internal combustion engines suited to the disclosed fuel supply system may include self-ignited or spark ignited internal combustion engines.

In the following, operation of fuel supply system 100 as described with reference to FIGS. 1 to 3 is described in connection with FIG. 4. However, the skilled person will appreciate that the respective steps of the control procedure can be performed on other embodiments as well.

Figure 4:
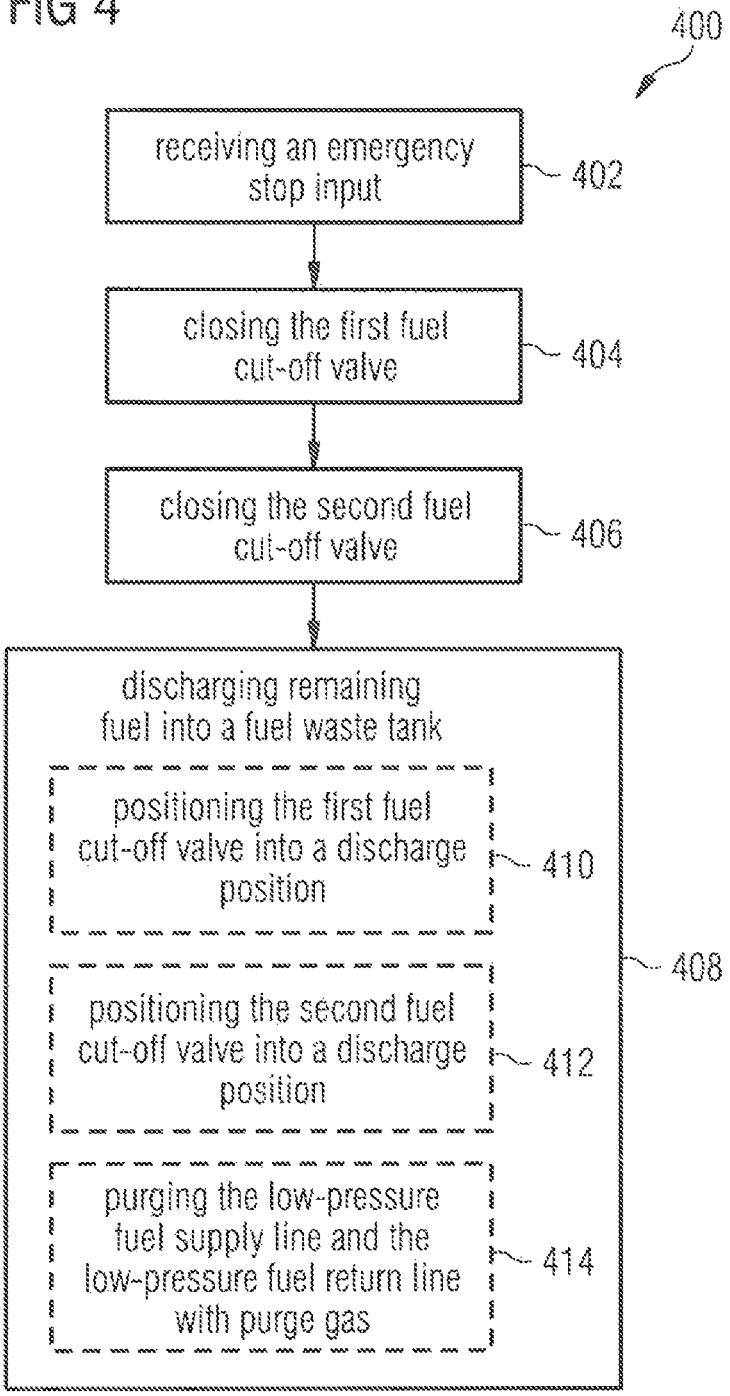
FIG. 4 shows a schematic flow chart of an exemplary control procedure of operating a fuel supply system.

Referring to FIG. 4, an exemplary control procedure 400 of operating fuel supply system 100 as exemplarily disclosed herein is schematically illustrated.

At initial step 402, control unit 300 receives an emergency stop input. The emergency stop input may be provided by an operator of internal combustion engine 110 or may be issued by another control device in control communication with internal combustion engine 110 and control unit 300. The emergency stop input is indicative of an emergency of internal combustion engine 110. For example, internal combustion engine 110 may exhibit an engine speed higher than an engine speed threshold, a load of internal combustion engine 110 may be higher than a maximal tolerable engine load, a temperature of internal combustion engine 110 may exceed a maximal engine temperature, or a lubricant pressure provided to internal combustion engine 110 may be lower than a minimal lubricant pressure. In all cases control unit 300 receives an emergency stop input, because further operation of internal combustion engine 110 is critical, and, thus, operation of internal combustion engine 110 has to stop.

At step 404, upon receiving the emergency stop input, control unit 300 closes first fuel cut-off valve 200. By closing first fuel cut-off valve 200, a connection between low-pressure fuel supply line 150 and fuel supply tank 140 is disabled. As a result, a flow of fuel from fuel supply tank 140 to the plurality of fuel injection pumps 170 is stopped. As a consequence, after some time, e.g. the time required for internal combustion engine 110 to consume remaining fuel contained in low-pressure fuel supply line 150, internal combustion engine 110 stops its operation.

However, in embodiments where fuel supply system 100 further includes a second fuel cut-off valve 240 (see FIGS. 2 and 3), at step 406 control unit 300 may further close second fuel cut-off valve 240. By closing second fuel cut-off valve 240, a connection between low-pressure fuel return line 160 and fuel waste tank 250 is disabled. As a result, a flow of fuel from fuel supply tank 140 back to the plurality of fuel injection pumps 170 caused by fuel being sucked in is stopped. By closing second fuel cut-off valve 240, a remaining amount of fuel for internal combustion engine 110 to be consumed is reduced. Thus, the time required until internal combustion engine 110 stops its operation is reduced. Steps 404 and 406 may be performed simultaneously or in sequence. Moreover, step 406 may be performed before step 404 is performed.

A time required until internal combustion engine 110 stops its operation may be reduced further, when remaining fuel contained in low-pressure fuel supply line 150 and low-pressure fuel return line 160 is discharged into fuel waste tank 250. Thus, control procedure 400 may include step 408, where remaining fuel contained in low-pressure fuel supply line 150, low-pressure fuel supply line portions 155, low-pressure fuel return line 160 and low-pressure fuel return line portions 165 is discharged into fuel waste tank 250. As fuel waste tank 250 is fluidly connected to low-pressure fuel supply line 150 via first fuel cut-off valve 200, and fluidly connected to low-pressure fuel return line 160 via second fuel cut-off valve 240, step 408 may include further control steps. For example, at step 410, first fuel cut-off valve 200 is positioned into a discharge position. In the discharge position of first fuel cut-off valve 200 a connection AC between low-pressure fuel supply line 150 and fuel waste tank 250 is enabled, whereas a connection AB between low-pressure fuel supply line 150 and fuel supply tank 140 is disabled. Thus, positioning first fuel cut-off valve 200 into the discharge position may be performed simultaneously to closing first fuel cut-off valve 200 at step 404. In other words, positioning first fuel cut-off valve 200 into the discharge position may be identical with closing first fuel cut-off valve 200 at step 404. When first fuel cut-off valve 200 is positioned in the discharge position, fuel can freely flow from low-pressure fuel supply line 150 into fuel waste tank 250 and the time required until internal combustion engine 110 stops its operation reduces further.

Likewise, at step 412, second fuel cut-off valve 240 is positioned into a discharge position. In the discharge position of second fuel cut-off valve 240 a connection DF between low-pressure fuel return line 160 and fuel waste tank 250 is enabled, whereas a connection DE between low-pressure fuel return line 160 and fuel supply tank 140 is disabled. Thus, positioning second fuel cut-off valve 240 into the discharge position may be performed simultaneously to closing second fuel cut-off valve 240 at step 406. In other words, positioning second fuel cut-off valve 240 into the discharge position may be identical with closing second fuel cut-off valve 240 at step 406. When second fuel cut-off valve 240 is positioned in the discharge position, fuel can freely flow from low-pressure fuel return line 160 into fuel waste tank 250 and the time required until internal combustion engine 110 stops its operation reduces further.

Moreover, in embodiments where purge gas supply line 210 is connected to low-pressure fuel supply line 150 and/or low-pressure fuel return line 160, discharging of remaining fuel into fuel waste tank 250 may be hastened further. Thus, control unit 300 may perform step 414 where control unit 300 purges low-pressure fuel supply line 150 and low-pressure fuel return line 160 with purge gas supplied by purge gas supply line 210. Depending on where purge gas supply line 210 is connected to low-pressure fuel supply line 150 and/or low-pressure fuel return line 160, step 414 may include positioning first fuel cut-off valve 200 into a purge position. In the purge position of first fuel cut-off valve 200 a connection AC between low-pressure fuel supply line 150 and fuel waste tank 250 is enabled, whereas a connection AB between low-pressure fuel supply line 150 and fuel supply tank 140 is disabled. Thus, positioning first fuel cut-off valve 200 into the purge position is identical with positioning first fuel cut-off valve 200 into discharge position. In other words, positioning first fuel cut-off valve 200 into the purge position may not be necessary, when first fuel cut-off valve 200 is already positioned in the discharge position.

Likewise, step 414 also includes positioning second fuel cut-off valve 240 into a purge position. In the purge position of second fuel cut-off valve 240 a connection DF between low-pressure fuel return line 160 and fuel waste tank 250 is enabled, whereas a connection DE between low-pressure fuel return line 160 and fuel supply tank 140 is disabled. Thus, positioning second fuel cut-off valve 240 into the purge position is identical with positioning second fuel cut-off valve 240 into discharge position. In other words, positioning second fuel cut-off valve 240 into the purge position may not be necessary, when second fuel cut-off valve 240 is already positioned in the discharge position.

At a further control step (not shown) control unit 300 may enable a flow of purge gas through purge gas supply line 210 by controlling purge gas control valve 230. Once purge gas flows through purge gas supply line 210 and subsequently through low-pressure fuel supply line 150 and low-pressure fuel return line 160, remaining fuel is discharged into fuel waste tank 250. Thus, a time required until internal combustion engine 110 stops its operation is reduced further.

Generally, the terms "downstream" and "upstream" as used herein are referenced with respect to the direction of fuel flow as indicated by the arrows.

Moreover, in any of the embodiments described herein, the first fuel cut-off valve may be a single first fuel cut-off valve disposed in the low-pressure fuel supply line and configured to stop a flow of fuel from the fuel supply tank to the plurality of fuel injection pumps.

Moreover, in any of the embodiments described herein, the second fuel cut-off valve may be a single second fuel cut-off valve disposed in the low-pressure fuel return line and configured to stop a flow of fuel in the single low-pressure fuel return line from the fuel supply tank back to the plurality of fuel injection pumps.

Moreover, the fuel cut-off valves as disclosed herein may also be known as fuel shut-off valves.

Moreover, in any of the embodiments described herein, the low-pressure fuel supply line may be a single low-pressure fuel supply line fluidly connected to the plurality of fuel injection pumps and configured to provide fuel from a fuel supply tank to the plurality of fuel injection pumps.

Moreover, in any of the embodiments described herein, the low-pressure fuel return line may be a single low-pressure fuel return line fluidly connected to the plurality of fuel injection pumps and configured to return remaining fuel from the plurality of fuel injection pumps to the fuel supply tank.

Moreover, the fuel supply tank and the fuel waste tank may be a single tank.

Moreover, instead of discharging remaining fuel and/or purge gas into the fuel waste tank, remaining fuel and/or purge gas may be also discharged into the fuel supply tank.

Moreover, the plurality of fuel injection pumps may be disposed in any other suitable configuration than the shown linear configuration.

Moreover, the term "3/2 valve" as used herein refers to a valve with three ports, e.g. three connections, and two positions.

Moreover, in any of the embodiments described herein, a flow of purge gas is adjusted such that substantially no purge gas and no remaining fuel enters the high-pressure fuel supply lines.

Although various embodiments have been described herein, improvements and modifications may be incorporated without departing from the scope of the following claims.

The invention claimed is:

1. A fuel supply system for an internal combustion engine, the fuel supply system comprising:

a plurality of fuel injection pumps, each fuel injection pump of the plurality of fuel injection pumps being configured to pressurize fuel and provide the pressurized fuel to an associated fuel injector;

a low-pressure fuel supply line fluidly connected to the plurality of fuel injection pumps and configured to provide fuel from a fuel supply tank to the plurality of fuel injection pumps;

a low-pressure fuel return line fluidly connected to the plurality of fuel injection pumps and configured to return remaining fuel from the plurality of fuel injection pumps to the fuel supply tank;

a first fuel cut-off valve disposed in the low-pressure fuel supply line, the fuel supply tank being in fluid communication with the plurality of fuel injection pumps via the first fuel cut-off valve;

a purge gas supply line fluidly connected to the low-pressure fuel supply line via a purge gas control valve; and a controller operatively coupled to the first fuel cut-off valve, the controller being configured to receive a stop signal while the internal combustion engine is operating to produce mechanical power from the fuel supplied from the fuel supply tank, stop operation of the internal combustion engine in response to the stop signal by closing the first fuel cut-off valve, thereby blocking fluid communication between the fuel supply tank and the plurality of fuel injection pumps, and purge the low-pressure fuel supply line while the internal combustion engine is operating, by opening the purge gas control valve in response to receiving the stop signal.

2. The fuel supply system according to claim 1, wherein the purge gas supply line is fluidly connected to the low-pressure fuel supply line at a connection point disposed downstream of the first fuel cut-off valve and upstream of the plurality of fuel injection pumps.

3. The fuel supply system according to claim 1, wherein the purge gas supply line is connected to the low-pressure fuel supply line via the first fuel cut-off valve.

4. The fuel supply system according to claim 1, further comprising a second fuel cut-off valve disposed in the low-pressure fuel return line, the plurality of fuel injection pumps being in fluid communication with the fuel supply tank via the second fuel cut-off valve, the controller being further configured to block fluid communication between the plurality of fuel injection pumps and the fuel supply tank while the internal combustion engine is operating, by closing the second fuel cut-off valve in response to the stop signal.

5. The fuel supply system according to claim 4, further comprising a fuel waste tank fluidly connected to the low-pressure fuel supply line via the first fuel cut-off valve and fluidly connected to the low-pressure fuel return line via the second fuel cut-off valve, the controller being further configured to effect fluid communication between the low-pressure fuel supply line and the fuel waste tank while the internal combustion engine is operating, by actuating the first fuel cut-off valve in response to the stop signal, and effect fluid communication between the low-pressure fuel return line and the fuel waste tank while the internal combustion engine is operating, by actuating the second fuel cut-off valve in response to the stop signal.

6. The fuel supply system according to claim 5, further comprising a purge gas supply line fluidly connected to the low-pressure fuel supply line via a purge gas control valve and the plurality of fuel injection pumps, the purge gas control valve being disposed fluidly in series between the purge gas supply line and the plurality of fuel injection pumps, the controller being further configured to purge the plurality of fuel injection pumps and the low-pressure fuel supply line while the internal combustion engine is operating, by opening the purge gas control valve in response to the stop signal.

7. The fuel supply system according to claim 6, wherein the controller is further configured to effect fluid communication between the purge gas supply line and the fuel waste tank via the low-pressure fuel supply line while the internal combustion engine is operating, by actuating the first fuel cut-off valve in response to the stop signal, and effect fluid communication between the purge gas supply line and the fuel waste tank via the low-pressure fuel return line while the internal combustion engine is operating, by actuating the second fuel cut-off valve in response to the stop signal.

8. The fuel supply system according to claim 1, further comprising a purge gas supply line fluidly connected to the plurality of fuel injection pumps via a purge gas control valve, the plurality of fuel injection pumps being disposed fluidly in series between the purge gas control valve and the low-pressure fuel supply line, the plurality of fuel injection pumps being disposed fluidly in series between the purge gas control valve and the low-pressure fuel return line, the controller being further configured to purge the plurality of fuel injection pumps, the low-pressure fuel supply line, and the low-pressure fuel return line while the internal combustion engine is operating, by opening the purge gas control valve in response to the stop signal.

9. A method for operating a fuel supply system for an internal combustion engine, the fuel supply system comprising a plurality of fuel injection pumps;

a low-pressure fuel supply line connected to the plurality of fuel injection pumps and configured to provide fuel from a fuel supply tank to the plurality of fuel injection pumps;

a low-pressure fuel return line fluidly connected to the plurality of fuel injection pumps and configured to return remaining fuel from the plurality of fuel injection pumps to the fuel supply tank;

a first fuel cut-off valve disposed in the low-pressure fuel supply line;

a purge gas supply line fluidly connected to the low-pressure fuel supply line via a purge gas control valve; and a controller operatively coupled to the first fuel cut-off valve, the method comprising the steps of:

operating the internal combustion engine to produce mechanical power from the fuel supplied from the fuel supply tank;

receiving, at the controller, an emergency stop input indicative of an emergency of the internal combustion engine while the internal combustion engine is operating;

stopping operation of the internal combustion engine in response to the receiving the emergency stop input by closing the first fuel cut-off valve via the controller, thereby blocking fluid communication between the fuel supply tank and the plurality of fuel injection pumps; and purging the low-pressure fuel supply line while the internal combustion engine is operating, by opening the purge gas control valve in response to receiving the stop signal.

10. The method according to claim 9, further comprising:

closing a second fuel cut-off valve disposed in the low-pressure fuel return line and configured to stop a flow of fuel in the low-pressure fuel return line from the fuel supply tank back to the plurality of fuel injection pumps.

11. The method according to claim 10, further comprising:

discharging remaining fuel from the low-pressure fuel supply line and the low-pressure fuel return line into a fuel waste tank fluidly connected to the low-pressure fuel supply line via the first fuel cut-off valve and fluidly connected to the low-pressure fuel return line via the second fuel cut-off valve.

12. The method according to claim 11, wherein the step of discharging remaining fuel further comprises:

positioning the first fuel cut-off valve in a discharge position such that the low-pressure fuel supply line is disconnected from the fuel supply tank and connected to the fuel waste tank; and positioning the second fuel cut-off valve in a discharge position such that the low-pressure fuel return line is disconnected from the fuel supply tank and connected to the fuel waste tank.

13. The method according to claim 12, wherein the step of discharging remaining fuel further comprises:

purging the low-pressure fuel supply line and the low-pressure fuel return line with purge gas.

14. An internal combustion engine, comprising:

an engine block, the engine block including a plurality of cylinders;

a plurality of fuel injectors configured to inject fuel into the plurality of cylinders, each fuel injector of the plurality of fuel injectors being uniquely coupled in fluid communication with one cylinder of the plurality of cylinders; and a fuel supply system for supplying fuel to each fuel injector of the plurality of fuel injectors, the fuel supply system including:

a plurality of fuel injection pumps, each fuel injection pump of the plurality of fuel injection pumps being uniquely coupled in fluid communication with one corresponding fuel injector of the plurality of fuel injectors, each fuel injection pump being configured to pressurize fuel and provide the pressurized fuel to the one corresponding fuel injector;

a low-pressure fuel supply line fluidly connected to the plurality of fuel injection pumps and configured to provide fuel from a fuel supply tank to the plurality of fuel injection pumps;

a low-pressure fuel return line fluidly connected to the plurality of fuel injection pumps and configured to return remaining fuel from the plurality of fuel injection pumps to the fuel supply tank;

a first fuel cut-off valve disposed in the low-pressure fuel supply line, the fuel supply tank being in fluid communication with the plurality of fuel injection pumps via the first fuel cut-off valve;

a purge gas supply line fluidly connected to the low-pressure fuel supply line via a purge gas control valve; and a controller operatively coupled to the first fuel cut-off valve, the controller being configured to receive a stop signal while the internal combustion engine is operating to produce mechanical power from the fuel supplied from the fuel supply tank, stop operation of the internal combustion engine in response to the stop signal by closing the first fuel cut-off valve, thereby blocking fluid communication between the fuel supply tank and the plurality of fuel injection pumps, and purge the low-pressure fuel supply line while the internal combustion engine is operating, by opening the purge gas control valve in response to receiving the stop signal.

15. The internal combustion engine according to claim 14, wherein the purge gas supply line is fluidly connected to the low-pressure fuel supply line at a connection point disposed downstream of the first fuel cut-off valve and upstream of the plurality of fuel injection pumps.

16. The internal combustion engine according to claim 14, further comprising a second fuel cut-off valve disposed in the low-pressure fuel return line, the plurality of fuel injection pumps being in fluid communication with the fuel supply tank via the second fuel cut-off valve, the controller being further configured to block fluid communication between the plurality of fuel injection pumps and the fuel supply tank while the internal combustion engine is operating, by closing the second fuel cut-off valve in response to the stop signal.

17. The internal combustion engine according to claim 16, further comprising a fuel waste tank fluidly connected to the low-pressure fuel supply line via the first fuel cut-off valve and fluidly connected to the low-pressure fuel return line via the second fuel cut-off valve, the controller being further configured to effect fluid communication between the low-pressure fuel supply line and the fuel waste tank while the internal combustion engine is operating, by actuating the first fuel cut-off valve in response to the stop signal, and effect fluid communication between the low-pressure fuel return line and the fuel waste tank while the internal combustion engine is operating, by actuating the second fuel cut-off valve in response to the stop signal.

18. The internal combustion engine according to claim 17, further comprising a purge gas supply line fluidly connected to the low-pressure fuel supply line via a purge gas control valve and the plurality of fuel injection pumps, the purge gas control valve being disposed fluidly in series between the purge gas supply line and the plurality of fuel injection pumps, the controller being further configured to purge the plurality of fuel injection pumps and the low-pressure fuel supply line while the internal combustion engine is operating, by opening the purge gas control valve in response to the stop signal.

* * * * *